US006792125B1

(12) United States Patent
David et al.

(10) Patent No.: US 6,792,125 B1
(45) Date of Patent: Sep. 14, 2004

(54) PIVOTABLE SPEAKER MOUNTING APPARATUS

(75) Inventors: John R. David, Medford, MA (US); Leo Kiefer, Peabody, MA (US); David G. Kroll, Attleboro, MA (US)

(73) Assignee: Boston Acoustics, Inc., Peabody, MA (US)

( * ) Notice: Subject to any disclaimer, the term of this patent is extended or adjusted under 35 U.S.C. 154(b) by 63 days.

(21) Appl. No.: 09/644,468

(22) Filed: Aug. 23, 2000

(51) Int. Cl.[7] ..... H04R 1/00
(52) U.S. Cl. ..... 381/397; 381/396; 381/152
(58) Field of Search ..... 381/152, 386, 381/387, 392, 396, 397, 411, 415, 412, 413, 345

(56) References Cited

U.S. PATENT DOCUMENTS 4,597,470 A * 7/1986 Takagi et al. ..... 181/141
4,811,403 A * 3/1989 Henricksen et al. ..... 381/159
4,923,032 A * 5/1990 Nuernberger ..... 381/386
5,133,428 A 7/1992 Perrson
5,450,499 A * 9/1995 Morris et al. ..... 381/386
5,859,917 A * 1/1999 Silber et al. ..... 381/387
5,960,095 A * 9/1999 Chang ..... 381/387
5,970,158 A * 10/1999 Beltran ..... 381/341
6,002,780 A 12/1999 Espiritu
6,516,076 B1 * 2/2003 Martin ..... 381/340

* cited by examiner

*Primary Examiner*—Rexford Barnie
(74) *Attorney, Agent, or Firm*—Wolf, Greenfield & Sacks, P.C.

(57) ABSTRACT

A speaker mounting apparatus is provided which facilitates pivoting of the speaker to a desired angular position, while providing increased thermal mass for the speaker assembly. For preferred embodiments, the speaker is mounted in a cup of a thermally conductive material, which cup has a surface which mates with a corresponding surface of a mount in a manner so as to permit the speaker to be pivoted to a desired angular position, to be held in such position and, for preferred embodiments, to permit heat transfer from the cup to the mount, which is also of a thermally conductive material, further increasing the thermal mass of the apparatus.

29 Claims, 6 Drawing Sheets

PIVOTABLE SPEAKER MOUNTING APPARATUS

FIELD OF THE INVENTION

This invention relates to audio speakers, and more particularly, to an improved apparatus for mounting wall or panel mounted speakers which facilitates both the pivoting of the speaker, particularly a tweeter, so that the speaker may be aimed at a listening area and the improved removal of heat from such pivotable speaker.

BACKGROUND OF THE INVENTION

Speakers which are flush mounted in a wall, panel or other suitable location are becoming increasingly popular in conjunction with various audio and multimedia systems, particularly ones used in homes and offices. However, since aesthetic considerations often dictate the positioning of such speakers, the speakers are frequently forced to operate in locations which are not ideal either from an audio or an environmental standpoint. In particular, such speakers are often expected to be "invisible", both as a result of physical shape and physical location at the installation site. As a result, many such speakers are placed near corners, high on a wall, for example near the ceiling, low on the mounting surface, for example near the floor, or at other "out of sight" locations. Aesthetic considerations thus result in the loudspeaker rarely being in an ideal acoustical position, with the listener positioned on a substantially perpendicular axis of the speaker; thus requiring that such speakers have uniform, accurate off-axis response in order to maintain superior sound quality. While careful system and cross over design can ensure that most frequencies are reproduced evenly at most off-axis locations, extreme high-frequency content is usually restricted by the geometry of practical high-frequency drive units, and therefore does not radiate evenly in all directions.

One way this problem has been dealt with has been that, rather than insisting on stringent requirements on the uniformity of high frequency radiation in all directions, high frequency speakers (i.e., tweeters) are mounted so that they can be pivoted or aimed, permitting the signal content in the directional band of the tweeter to be properly radiated into the listening area.

However, a problem with existing pivoting tweeters is that the tweeter assembly must be kept small in order to have it fit in a reasonably-sized pivoting mechanism. This generally requires that neodymium magnets or tiny, inefficient ceramic magnets be used to keep the size of the tweeter to a minimum, resulting in a tweeter having little thermal mass and few heat-radiating surfaces. These speakers can therefore handle only modest power without thermal failure. This speaker heating problem is aggravated by the fact that such speakers are frequently mounted in small areas between or behind walls or in other areas with poor air flow for heat removal.

Speaker manufacturers frequently employ high cross-over frequencies in designing these speakers in order to limit the power input to the tweeter; however, this may result in a poor match in dispersion from the woofer to the tweeter. In some cases, a third, mid-high frequency driver must be added to fill in the missing bandwidth, resulting in a much more costly product and a more complex overall system.

A need therefore exists for an improved pivotable speaker mount, particularly for small, high frequency speakers or tweeters, which, in addition to being easily pivotable to permit optimum aiming of the speaker, also facilitates heat removal from the speaker, permitting it to operate at the power levels required for most audio applications without thermal failure.

SUMMARY OF THE INVENTION

In accordance with the above, this invention provides a speaker mounting apparatus which facilitates pivoting of the speaker to a desired angular position, while providing increased thermal mass for the speaker assembly, thereby facilitating removal of heat from the speaker. More specifically, the apparatus includes a cup in which at least a drive portion of the speaker is mounted and a mount, the cup and mount being formed and coacting when assembled to each other to facilitate the pivoting of the speaker to a desired angular position and at least the cup providing increased thermal mass for removal of heat from the speaker. The speaker is preferably mounted in the cup so as to facilitate removal of heat from the speaker to the cup and both the cup and mount are preferably formed of materials having good heat transfer properties. A mechanism should also be provided for maintaining good thermal contact between the cup and mount, at least when the speaker is in operation. For preferred embodiments, the thermal contact is between mating surfaces on the cup and mount respectively, the surfaces being shaped to facilitate pivoting of the cup, and thus the speaker, in the mount. A mechanism is preferably provided for normally maintaining the mating surfaces in pressure contact to hold an angular position for the speaker and to facilitate heat transfer from the cup to the mount, while permitting the speaker to be moved to a new angular position. For preferred embodiments, the mechanism permits the pressure contact to be relieved to facilitate pivoting of the speaker to a new angular position.

More specifically, the speaker mounting apparatus includes a cup formed of a material having good heat transfer properties, and having an internal cavity sized to hold at least a drive portion of the speaker, and a substantially uniformly curved outer surface. The mounting apparatus also includes a mount for the speaker, the mount being of a material having good heat transfer properties and having an opening formed therein with a uniformly curved inner surface sized and shaped to mate the curved outer surface of the cup when the speaker is mounted therein; and a mechanism for normally maintaining the mating surfaces in sufficient pressure contact to hold an angular position for the speaker and to facilitate heat transfer from the cup to the mount, while permitting the speaker to be pivoted to a new angular position. Again, the mechanism preferably permits the pressure contact to be relieved to facilitate the pivoting of the speaker. The cup and/or the mount are preferably formed from aluminum or another metal and the curved surfaces are preferably mating partially spherical surfaces. The mechanism for normally maintaining the surfaces in pressure contact may include a spring normally biasing the cup surface against the mating mount surface. For some embodiments, the mount includes a baffle, which baffle may mount a plurality of speakers, at least one of which may be pivotable. A frame of a thermally conductive material may also be provided, the baffle and frame being formed to provide good thermal contact therebetween. The cup may also have fins, with air flowing over the fins at least as a result of convection, to facilitate removal of heat therefrom. Components may also be provided for inhibiting rotation between the cup and mount and/or between the cup and speaker. Mating tabs and slots may, for example, be provided on the mating surfaces of the cup and mount to inhibit rotation therebetween.

For reasons indicated earlier, the speaker is general a high frequency tweeter. For some embodiments, a stem mount is provided which supports such tweeter over a lower frequency speaker. The stem mount is generally of a material having poor heat transfer properties so as to thermally isolate the two speakers and minimize heat transfer therebetween. For this embodiment, the mount for the speaker may have a scalloped square outer surface to enhance audio performance, and in particular to reinforce at the low end of the tweeter frequency response.

The foregoing and other objects, features and advantages of the invention will be apparent from the following more particular description of a preferred embodiment of the invention as illustrated in the accompanying drawings.

DRAWINGS

DETAILED DESCRIPTION

Figure 1:
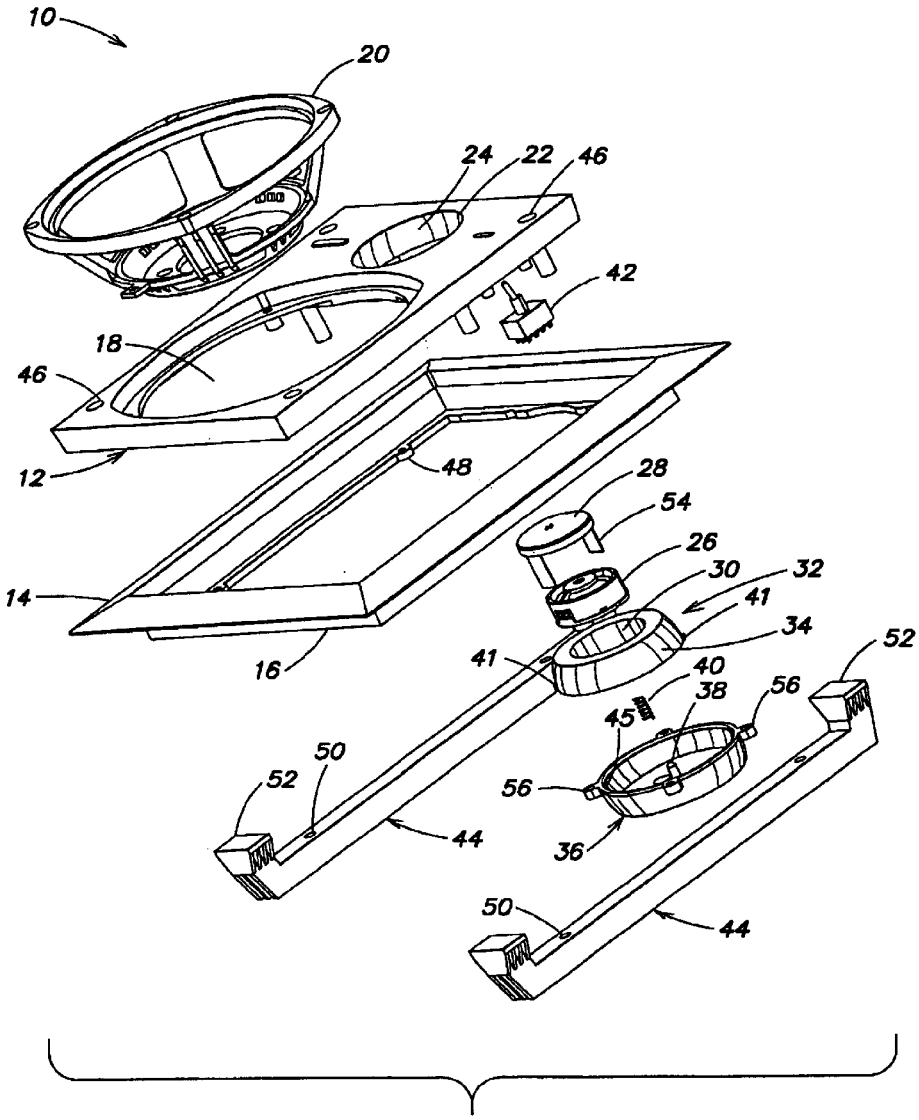
FIG. 1 is an exploded front/side perspective view of a first embodiment for a speaker assembly incorporating the teachings of this invention.

Referring first to the embodiment of FIGS. 1–4, the speaker assembly 10 includes a mount or baffle 12 formed of a material having good heat transfer properties, for example aluminum or some other metal, which is mounted in a frame 14 having an extended portion 16. Baffle 12 has a first opening 18 formed therein which is sized and shaped to receive the basket 20 of a woofer or other low or mid-range speaker and a second opening 22 formed therein having a wall 24 which is a partially spherical surface curving outward from the front face of baffle 12. The speaker assembly also includes a tweeter/high frequency speaker 26 having a grill or cover 28. At least the drive portion of tweeter 26, and preferably the entire tweeter fits snuggly in a cavity 30 formed in cup 32. Cup 32 is also formed of a material having good heat transfer properties, for example aluminum or some other metal which has good heat transfer properties, and has a curved outer surface 34 which is sized and shaped to mate with surface 24 of opening 22. As indicated earlier, for preferred embodiments, surfaces 24 and 34 are both partial spherical surfaces; however, this is not a limitation on the invention and other appropriate mating, uniformly curving surfaces might also be utilized for the surfaces 24 and 34. The assembly also includes a rear cap 36 having a post 38 extending from approximately the center of its inside bottom wall. A spring 40 is mounted over post 38. Cup 32 also has a pair of tabs 41 extending from opposite sides near the bottom of wall 34. These tabs coact with at least one of key slots 43 in wall 24 and key slots 45 on an inside wall of cup 36 to prevent rotation of the cup, and thus of speaker 26, such rotation potentially stressing wire connections to the speaker, and thus potentially causing failure of such connections. Similarly, as may be best seen in FIG. 6, projections 47 may also be provided in cavity 30 which coact with grooves 49 in walls of tweeter 26 to inhibit rotation of the speaker in cup 32. Finally, the assembly has an electrical switch 42 and has a pair of brackets 44 which coact with frame 14 in a manner to be described shortly for mounting speaker assembly 10 to a wall or other panel.

Figure 2:
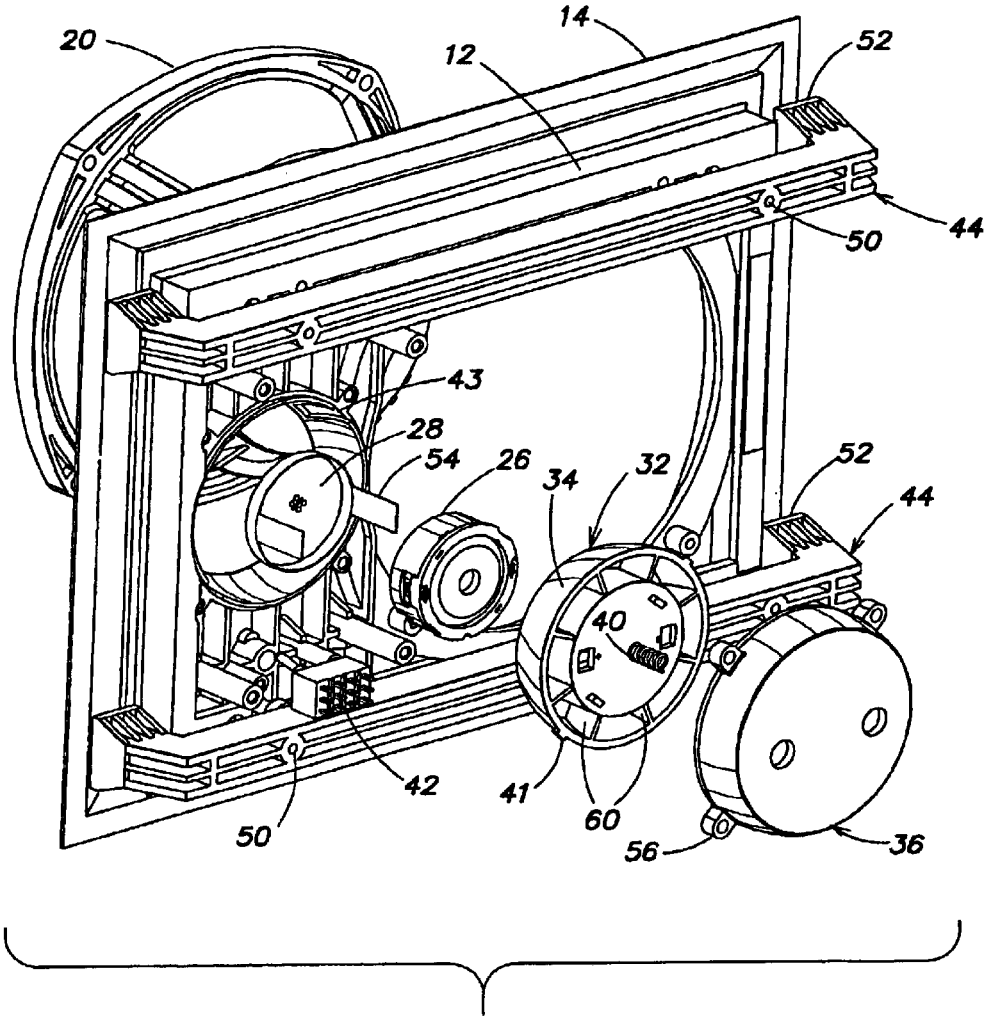
FIG. 2 is an exploded rear/top/side perspective of the speaker assembly of FIG. 1.
Figure 3:
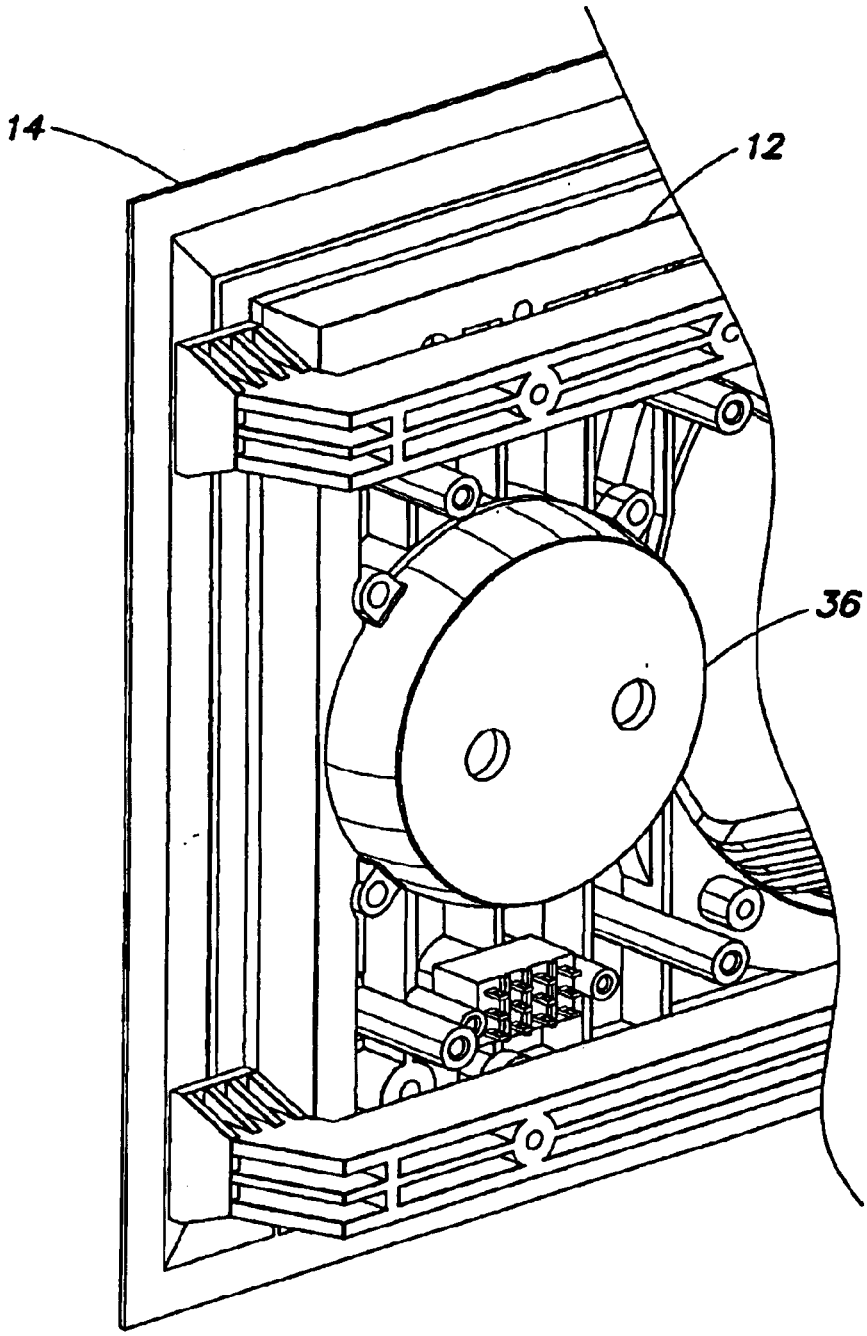
FIGS. 3 and 4 are partial rear and front perspective views respectively of the speaker assembly of FIG. 1 when assembled.
Figure 4:
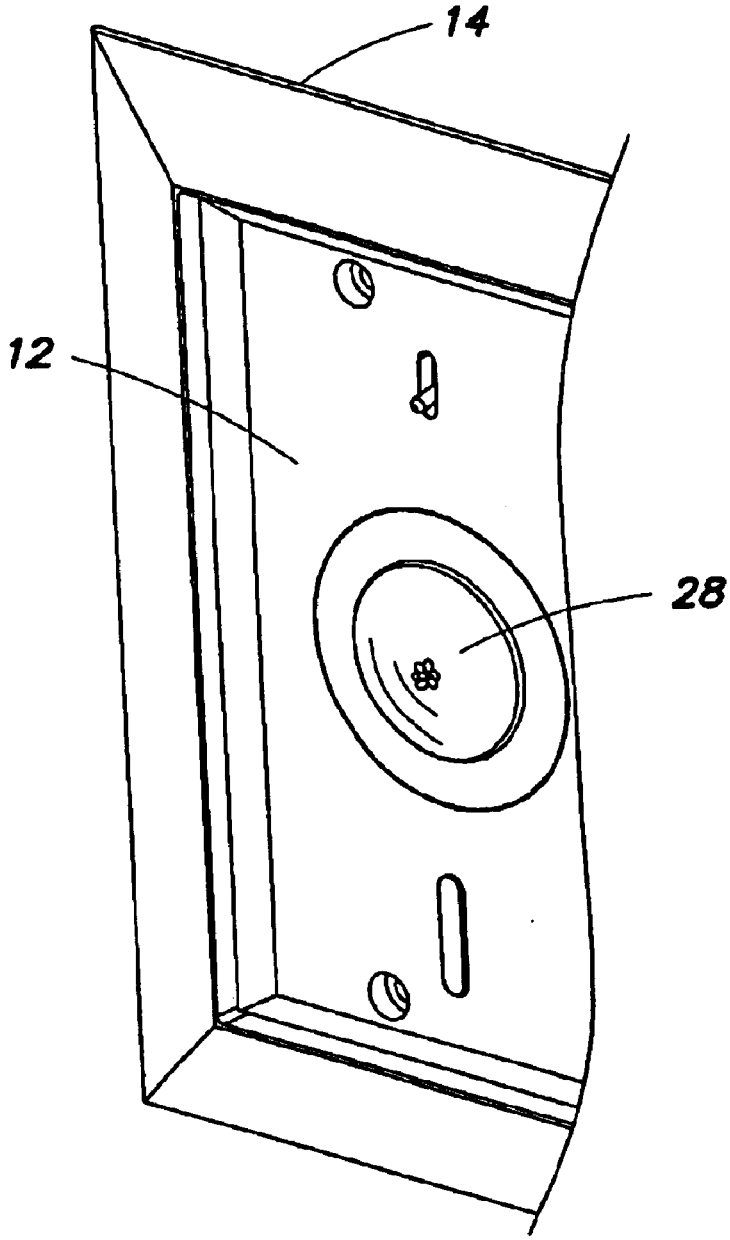

When the various components of FIGS. 1 and 2 are assembled as shown for example in FIGS. 3 and 4, screws (not shown) pass through openings 46 in baffle 12 and openings 48 in frame 14 to hold these components together. Either these or other screws pass through at least one of baffle 12 and frame 14 and terminate in holes 50 in brackets 44. The assembly is mounted to a wall or panel by inserting brackets 50 through an opening in such wall and fitting extension 16 in the opening. The four screws terminating in brackets 50 are then tightened, causing the wall to be pressed between frame 14 and feet 52 of the brackets to secure the assembly in place.

Tweeter 26 is mounted in cavity 30 of cup 32. The opening 30 is sized so that tweeter 26 fits snuggly therein, facilitating good physical and thermal contact between the tweeter and cup. Heat generated by tweeter 26 may thus be transferred to cup 32. Speaker cover 28 has a pair of tabs 54 which help hold tweeter 26 in cup 32.

Cup 32 is in turn mounted in cap 36 with its bottom surface bearing against spring 40. Cap 36 is then secured to baffle 12 as shown in FIG. 3 by screws (not shown), passing through openings in lugs 56. When so assembled, surface 34 of cup 32 mates with surface 24 of opening 22 in the baffle. Spring 40 pressing against cup 32 results in surfaces 24 and 34 being in pressure contact with each other. This pressure contact is sufficient to maintain a desired orientation between cup 30, and thus speaker 26, and baffle 12 and, for at least some embodiments, is sufficient to inhibit the angular position of the speaker from being changed. For such embodiments, the pressure contact between the surfaces may be relieved by pressing down on the speaker against the pressure of the spring to relieve the pressure contact between surfaces 24 and 34, thereby permitting reorientation of the speaker. For a weaker spring 40, such relieving of pressure contact between surfaces 24 and 34 may not be required to reorient the speaker.

Since speaker 26, or at least the heat-generating drive portion thereof, is seated in physical and thermal contact with the walls of cavity 30, cup 32 functions to increase the thermal mass of the speaker, heat generated in speaker 26 being transferred to cup 32. Similarly, cup 32 being in good physical and thermal contact with baffle 12 through mating surfaces 24 and 34, heat transferred to cup 32 can flow through the cup to baffle 12, thereby further increasing the thermal mass available to speaker 26, and thus facilitating even greater dissipation of heat from the speaker. As may be best seen in FIG. 2, cup 32 also has a plurality of fins 60 which further aid in the dissipation of heat. Basket 20 having poor heat flow characteristics assure substantial isolation between the speakers. Thus, the arrangement of FIGS. 1 and 2 results in a significant increase in the thermal mass of the speaker, and thus in the dissipation of heat generated by the speaker. This permits a roughly two-fold increase in the power handling capacity of the tweeter and would normally mean that such a pivoting tweeter could be utilized within its normal power operating range without danger of overheating.

Figure 5:
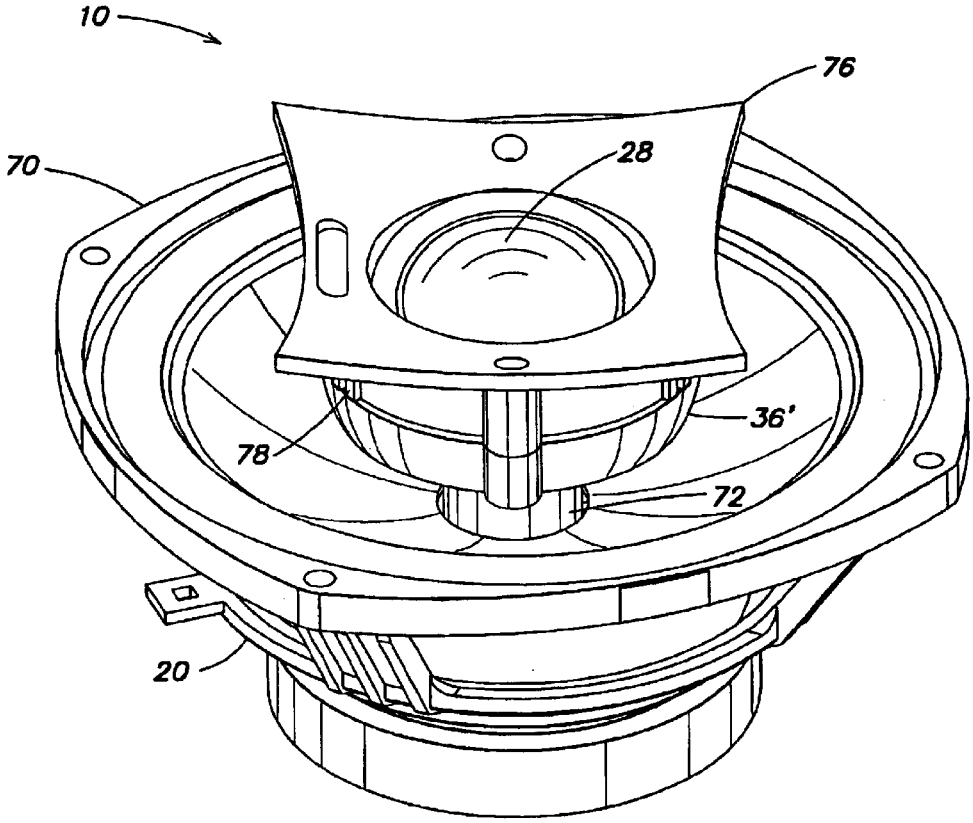
FIG. 5 is a front perspective view of a speaker assembly incorporating the teachings of this invention for a second embodiment.
Figure 6:
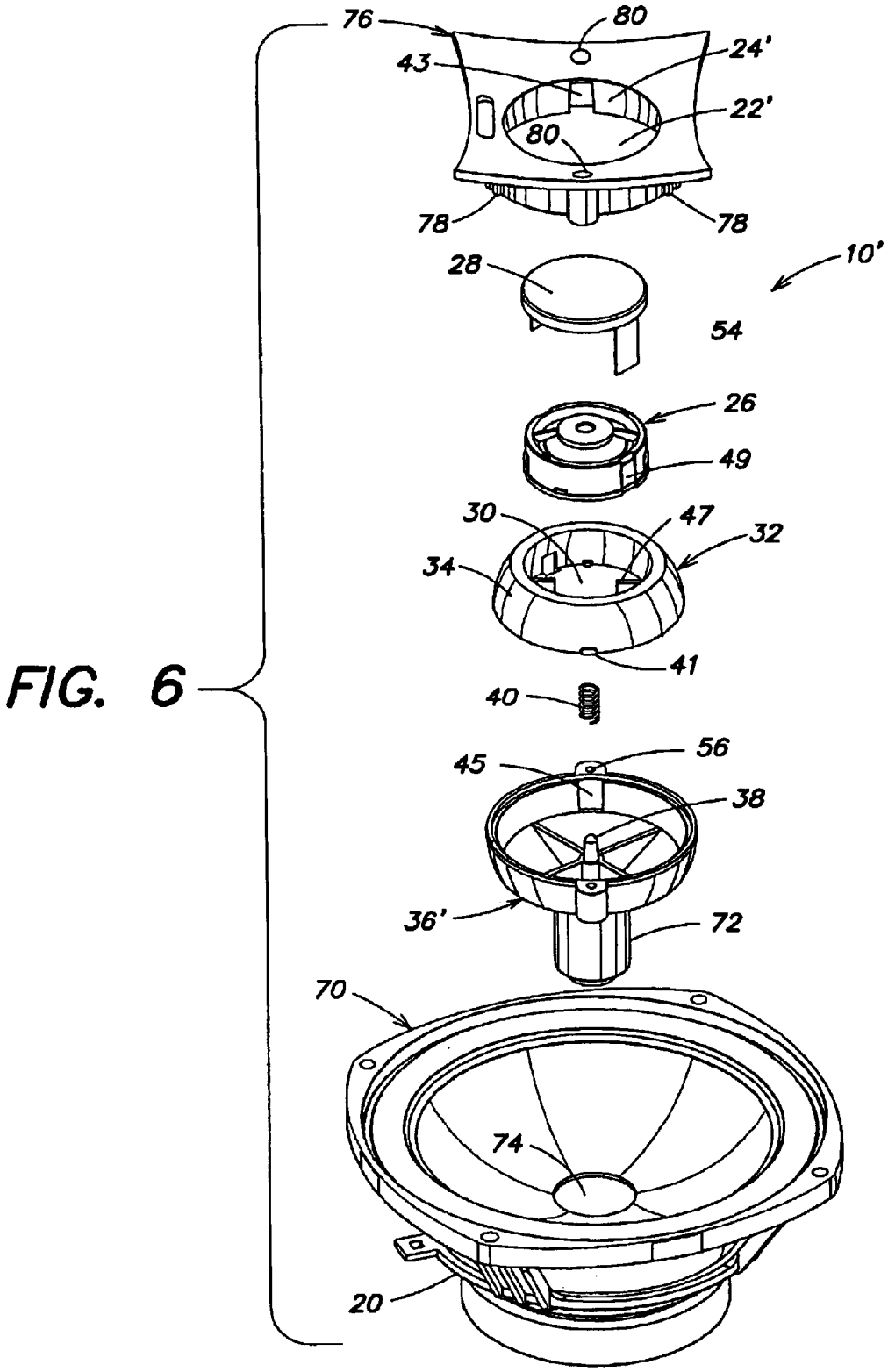
FIG. 6 is an exploded front perspective view of the speaker assembly shown in FIG. 5.

FIGS. 5 and 6 illustrate an alternative embodiment of the invention which differs from that of FIGS. 1–4 in that, instead of the main speaker and tweeter be mounted adjacent to each other on baffle 12, the speakers are instead coaxially mounted with the tweeter projecting over the main speaker 70. In particular, cap 36' has a stem or post 72 extending from the bottom or back thereof which fits in an opening 74 in the center of speaker 70 and is held in opening 74 by friction, glue and/or other suitable means. Stem 74 and cap 36' are preferably formed of material having poor heat transfer properties so as to thermally isolate speakers 26 and 70.

A second difference is that the baffle 76 for this embodiment has only a single opening 22' formed therein which opening has a partially spherical wall 24' which corresponds to the wall 24 of the FIG. 1 embodiment Baffle 76 also has a scalloped square outer surface which has esthetic value, but also has acoustic value, reinforcing the lower range of the frequency output from speaker 26. Finally, baffle 76 has a plurality of vanes 76 formed on a lower extended portion thereof, which vanes provide a larger surface area for sinking heat transferred to baffle 76 from speaker 26. While vanes 78 are shown as covering only roughly half of the outer surface of the extended portion for the embodiment illustrated in the figures, this is not a limitation on the invention and the number of vanes 78, their size, and the extent to which the cover the outer surface of the extended portion may vary depending on application. The vanes may also extend to the underside of the baffle wall or may have other form depending on application. Except as indicated above, the components of FIGS. 5 and 6 are substantially the same as those of FIGS. 1–4, are assembled in substantially the same way and function in substantially the same way to both permit the angular orientation of the tweeter to be controlled and to facilitate heat dissipation from tweeter 26. In particular, speaker 26 is snuggly mounted in cavity 30 of cup 32 and is held therein by tabs 54 coacting with the cup. Spring 40 is then mounted over post 38 and cup 32 mounted in the opening of cap 36'. Finally, baffle 76 is mounted over the assembly and screws (not shown) are passed through openings 80 15 in the baffle and secured in the openings of lugs 56 to hold the tweeter assembly together. As for the prior embodiment, spring 40 causes surface 34 to press against surface 24' to both facilitate the holding of a desired angular position for the speaker and to assure good thermal contact between cup 32 and baffle 76.

While the invention has been shown and described above with reference to preferred embodiments, it is apparent that these embodiments are for purposes of illustration only and that, for example, the teachings of this invention are not limited to a tweeter application, but could be utilized for any permanently mounted speaker for which it is desired to have a variable angular orientation. Further, while only one of the speakers in baffle 12 is reorientable for the embodiment shown, two or more reorientable speakers of this invention may be mounted to a single baffle. The specific nature and materials of each of the components, including in particular the baffles, frames and other mounting members of the speaker assembly, and their relative positions, could also vary with application. In particular, mating surfaces 24 and 34, while preferably spherical sections, could be sections of some other curved surface. Where less increase in thermal mass is required, only cup 32 may be of a thermally conductive material, baffle 12, 76 being of a material having lesser thermal properties, while if greater thermal mass is required, frame 14 could also be of a thermally conductive material. Baffle 12 and frame 14 could also be formed as a single piece of a thermally conductive or non-conductive material, as appropriate depending on the thermal mass required. Sufficient pressure contact between surfaces 24 and 34 may also be provided by cup 36 bearing against the rear of cup 32 without use of spring 40 or by other suitable means. Thus, while the invention has been particularly shown and described above with reference to preferred embodiments, the foregoing and other changes in form and detail may be made therein by one skilled in the art without departing from the spirit and scope of the invention which is to be limited only by the appended claims.

What is claimed is:

1. A speaker mounting apparatus including:

a) cup having a cavity in which at least a drive portion of the speaker is seated, the cavity having an interior surface conforming to the shape of the drive portion so that at least most of said drive portion is in thermal contact with the interior surface of said cavity, thereby facilitating removal of heat from said speaker to said cup; b) a mount c) a bias member; and d) wherein said cup and mount are formed of materials having good heat transfer properties and the bias member causing the cup and the mount to coact when assembled to facilitate the pivoting of said speaker to a desired angular position and to provide increased thermal conduction between the cup and the mount for removal of heat from said speaker.

2. Apparatus as claimed in claim 1, including a mechanism for maintaining good thermal contact between said cup and mount at least when said speaker is in operation.

3. Apparatus as claimed in claim 2, wherein said thermal contact is between mating surfaces on said cup and mount respectively, said surfaces being shaped to facilitate pivoting of said cup, and thus said speaker, in said mount.

4. Apparatus as claimed in claim 3, wherein the bias member normally maintains said surfaces in pressure contact to hold an angular position for said speaker and to facilitate heat transfer from said cup to said mount while permitting said speaker to be moved to a new angular position.

5. Apparatus as claimed in claim 4, wherein said bias member permits said pressure contact to be relieved to facilitate pivoting of said speaker a new angular position.

6. A pivoting speaker mounting apparatus including:

a cup formed of a material having good heat transfer properties, said cup having an internal cavity sized so that at least a drive portion of the speaker may be seated therein in good thermal contact with walls of said cavity, thereby facilitating removal of heat from said speaker to said cup, and a substantially uniformly curved outer surface;

a mount for said speaker, said mount being of a material having good heat transfer properties and having an opening formed therein with a uniformly curved inner surface sized and shaped to mate with said curved outer surface of the cup when the speaker is mounted therein, the mount having means for dissipating heat extending away from the opening; and a bias mechanism for normally maintaining said surfaces in sufficient pressure contact to hold an angular position for said speaker and to facilitate heat transfer from said cup to said mount, while permitting said speaker to be pivoted to a new angular position.

7. Apparatus as claimed in claim 6, wherein said mechanism permits said pressure contact to be relieved to facilitate pivoting of said speaker to a new angular position.

8. Apparatus as claimed in claim 6, wherein said cup is formed from at least one of aluminum and another metal.

9. Apparatus as claimed in claim 6, wherein said mount is formed from at least one of aluminum and another metal.

10. Apparatus as claimed in claim 6, wherein said curved surfaces are mating partially spherical surfaces.

11. Apparatus as claimed in claim 6, wherein said mechanism includes a spring normally biasing said cup surface against the mating mount surface.

12. Apparatus as claimed in claim 6, wherein said mount includes a baffle.

13. Apparatus as claimed in claim 12, wherein said baffle mounts a plurality of speakers, at least one of which is pivotable.

14. Apparatus as claimed in claim 12 including a frame of a thermally conductive material, said baffle and frame being formed to provide good thermal contact there between.

15. Apparatus as claimed in claim 6, wherein said cup has fins, air flowing over said fins at least as a result of convection.

16. Apparatus as claimed in claim 6, wherein said speaker is a high frequency tweeter.

17. Apparatus as claimed in claim 16, including a stem mount which mounts said mounting apparatus with said tweeter seated therein over a lower frequency speaker.

18. Apparatus as claimed in claim 17, wherein said stem mount is of a material having poor heat transfer properties to minimize heat transfer between said tweeter and low frequency speaker.

19. Apparatus as claimed in claim 17, wherein said mount for the speaker has a scalloped square outer surface.

20. Apparatus as claimed in claim 6 including components for inhibiting at least one of rotation of said cup in said mount and rotation of said speaker in said cup.

21. Apparatus as claimed in claim 20 wherein said component includes mating tabs and slots on the mating surfaces of said cup and mount to inhibit relative rotation there between.

22. A wall mounted speaker assembly including a pivoting speaker mounting apparatus including:

a cup formed of a material having good heat transfer properties, said cup having an outer surface and an internal cavity with sides and a bottom shaped so that at least a drive portion of the speaker may be seated therein in good thermal contact with the sides and the bottom of said cavity, thereby facilitating removal of heat from said speaker to said cup;

a mount for said speaker having an opening formed therein, the opening sized and shaped to mate with said outer surface of the cup when the cup is inserted in the opening; and a bias mechanism secured to the opposing face for normally maintaining the cup and the mount in sufficient pressure contact to hold an angular position for said speaker while permitting said speaker to be pivoted to a new angular position.

23. A pivoting speaker mounting apparatus including:

a cup formed of a material having good heat transfer properties, said cup having an internal cavity sized so that at least a drive portion of the speaker may be seated therein in good physical and thermal contact with walls of said cavity, thereby facilitating removal of heat from said speaker to said cup, and a substantially uniformly curved outer surface;

a first mount portion for said speaker, said first mount portion being of a material having good heat transfer properties and having an opening formed therein with a uniformly curved inner surface sized and shaped to mate with said curved outer surface of the cup when the speaker is mounted therein;

a mechanism for normally maintaining said surfaces in sufficient pressure contact to hold an angular position for said speaker and to facilitate heat transfer from said cup to said mount, while permitting said speaker to be pivoted to a new angular position; and a second mount portion in the form of a stem coupled to the first mount portion which positions the first mount portion and the cup with said speaker seated therein over a lower frequency speaker wherein said second mount portion is of a material having lower heat transfer properties than both said first mount portion and said cup to reduce heat transfer between said speaker and the lower frequency speaker.

24. A speaker assembly with a pivotable mounting apparatus for a tweeter, comprising:

a) a first member, the first member made of material with good thermal conductivity, b) a tweeter, the tweeter having a drive portion with an outer surface, the tweeter being mounted to the first member with substantially all of the outer surface in thermal contact with the first member so as to transfer heat generated in the drive portion to the first member;

c) a second member, made of a material with good thermal conductivity, the second member having i) a first portion shaped to conform to the first member, whereby the first member may pivot within the second member and the first member is, in use, in good thermal contact with the second member; and ii) a second portion, in thermal contact with the first portion, said second portion providing a mechanism to dissipate heat; and d) a third member fixedly attached relative to the second member, the third member including a bias mechanism that biases the first member towards the second member.

25. The speaker assembly of claim 24 wherein the first member is a cup.

26. The speaker assembly of claim 24 shaped as a wall mounted speaker and the second member is a baffle.

27. The speaker assembly of claim 26 where the first member is a cup and the baffle has an opening therein and the cup fits within the opening.

28. The speaker assembly of claim 26 wherein the baffle includes an opening for receiving a lower frequency speaker assembly.

29. The speaker assembly of claim 28 wherein the lower frequency speaker assembly has members of low thermal conductivity whereby heat flow from the lower frequency speaker to the baffle is reduced.

* * * * *